US012251006B2

(12) United States Patent
Hill

(10) Patent No.: US 12,251,006 B2
(45) Date of Patent: Mar. 18, 2025

(54) HAIR COLORING WAND

(71) Applicant: Aki Hill, Stone Mountain, GA (US)

(72) Inventor: Aki Hill, Stone Mountain, GA (US)

( * ) Notice: Subject to any disclaimer, the term of this patent is extended or adjusted under 35 U.S.C. 154(b) by 610 days.

(21) Appl. No.: 17/553,753

(22) Filed: Dec. 16, 2021

(65) Prior Publication Data

US 2022/0183442 A1 Jun. 16, 2022

Related U.S. Application Data

(60) Provisional application No. 63/126,506, filed on Dec. 16, 2020.

(51) Int. Cl.

| | |
|---|---|
| ***A45D 34/04*** | (2006.01) |
| ***A45D 19/02*** | (2006.01) |
| ***A45D 34/00*** | (2006.01) |

(52) U.S. Cl.

CPC ..... *A45D 34/04* (2013.01); *A45D 19/028* (2021.01); *A45D 2034/002* (2013.01); *A45D 2200/055* (2013.01)

(58) Field of Classification Search

CPC ..... A45D 34/00; A45D 34/04; A45D 34/042; A45D 34/043; A45D 2034/002; A45D 40/2428; A45D 40/261; A45D 40/262; A45D 40/264; A45D 24/00; A45D 24/007; A45D 24/22; A45D 24/24; A45D 24/26; A45D 24/28; A45D 19/00; A45D 19/02; A45D 19/12; A45D 19/16

See application file for complete search history.

(56) References Cited

U.S. PATENT DOCUMENTS

| | | | | |
|---|---|---|---|---|
| 8,347,894 | B1 * | 1/2013 | Stewart | A45D 24/28 132/114 |
| 10,271,627 | B1 * | 4/2019 | Calvo | A46B 11/001 |
| 2014/0076341 | A1 * | 3/2014 | Byun | B05B 11/1004 222/256 |
| 2016/0058153 | A1 * | 3/2016 | Madison | B65D 47/2031 222/482 |
| 2019/0053598 | A1 * | 2/2019 | Calhoun | A46B 11/0027 |
| 2022/0095778 | A1 * | 3/2022 | Watts | A46B 11/0041 |
| 2023/0180909 | A1 * | 6/2023 | Folchi | A45D 24/22 132/114 |

* cited by examiner

*Primary Examiner* — Rachel R Steitz
*Assistant Examiner* — Karim Asqiriba
(74) *Attorney, Agent, or Firm* — Law Offices of PL Mixon, LLC

(57) ABSTRACT

A hair coloring wand includes a container for holding a hair coloring agent, a coloring agent pump for suctioning the coloring agent from the container, and a dispensing paddle for receiving the coloring agent and from the use in sweeping the coloring agent on the top layer of the human hair. The dispensing paddle is removable to allow various paddles to be attached. The dispensing paddle includes a plurality of dispensing holes from which the coloring agent is dispensed from the dispensing paddle to the hair.

12 Claims, 9 Drawing Sheets

HAIR COLORING WAND

RELATED APPLICATIONS

This application is related to provisional application No. 63/126,506 filed, Dec. 16, 2020, and titled "Hair Color Wand," which his commonly invented by the inventor of this invention.

FIELD OF THE INVENTION

This invention generally relates to a hair coloring system. Specifically, the invention relates to a hair coloring wand for coloring human hair at home.

BACKGROUND OF THE INVENTION

Changing the color of hair is an important field in modern cosmetics. A skilled artisan that is familiar with hair coloring techniques typically change the color of hair inside a hair salon. The artisan will change the color of the hair, and often style the hair, depending on the coloring requirements to change the hair color.

Oxidation dyes are typically used for permanent, intense dyeing with good fastness properties and good gray coverage. Such coloring agents typically include oxidation dye precursors, so-called developer components and coupler components, which together form the actual dyes under the influence of oxidizing agents, such as, for example, hydrogen peroxide. Oxidation dyes are notable for outstanding, long-lasting color results, but are also associated to a certain degree with hair damage.

If one would like to change the hair color only temporarily, he/she can resort to coloring agents with direct dyes. In this case, already formed dyes diffuse from the coloring agent into the hair fiber. In comparison with oxidative hair coloring, the colors obtained with direct dyes have a lower durability and a more rapid washing out.

One drawback to traditional hair coloring methods is that the coloring ordinarily, must take place in a salon, which is time consuming and may require salon grade equipment. Also, when a global pandemic makes it preferable to social distance (e.g., maintain a prescribed one from another, attending a salon for a hair appointment can be hazardous to your health. In such a case, one who wishes to color their hair would want to be able to color their hair at home.

While various home hair coloring systems exists, these systems are limited in that they are only designed to provide one type of hair color technique, namely "highlighting." Conventional home coloring systems do not allow the user to apply popular hair coloring techniques such as the "Balayage." Balayage is a French word that means "to sweep." In this hair color technique, highlights are hand-painted or "swept" on the surface of random sections of hair. The Balayage techniques provides section of hair with coloring that is usually just a few shades lighter than your base color. Traditional home systems are not designed to allow the user to consistently deliver a hair coloring pattern for a specific hair style, without the use of foil.

What is needed is an at home hair coloring system that delivers hair coloring in accordance with a specific hair style, that minimizes the amount of equipment used at home.

BRIEF SUMMARY OF THE INVENTION

The present innovation is a hair coloring wand that allows a home user to evenly apply a hair coloring agent to hair without the use of bowls, foil and brushes. The hair coloring wand consists of a container for accepting a coloring agent for coloring hair. The coloring agent container has a coloring agent container first end and a coloring agent container second end. The coloring agent container second end is removable to allow a user to add a hair coloring agent to the body of the coloring agent container.

A coloring agent pump is affixed to the coloring agent container first end for pumping the hair coloring agent out of the container body. The pump provides the coloring agent to a specially designed dispensing paddle. The dispensing paddle is elongated and includes an inner cavity for receiving the coloring agent from the coloring agent pump.

The underside of the dispensing paddle includes a plurality of dispensing holes. The dispensing holes provide access to the dispensing paddle inner cavity. By actuating the coloring agent pump to pump coloring agent from the coloring agent container 200, the coloring agent, the coloring agent may then be dispensed from the dispensing holes in the dispensing paddles.

The dispensing holes in the dispensing paddle may be arranged according to user preference. In addition, the size or shape of the dispensing holes may be predetermined to affect the coloring agent's rate of dispersion or coloring agent's dispersion pattern.

The combination of the dispensing paddle shape, the shape and arrangement of the apertures, and rate of actuating the pump make is possible for the home user to achieve a more precise hair coloring patterns without visit a salon. The present invention may be used without the assistance of additional persons. Additionally, the user may practice this invention and achieve a desired hair style without the use of additional brushes, bowl, or combs.

BRIEF DESCRIPTION OF THE DRAWINGS

A more detailed understanding of the invention may be had from the following description, given by way of example, in conjunction with the accompanying drawings, wherein like numerals denote like elements. As depicted.

DETAILED DESCRIPTION OF PREFERRED EMBODIMENTS

Figure 1:
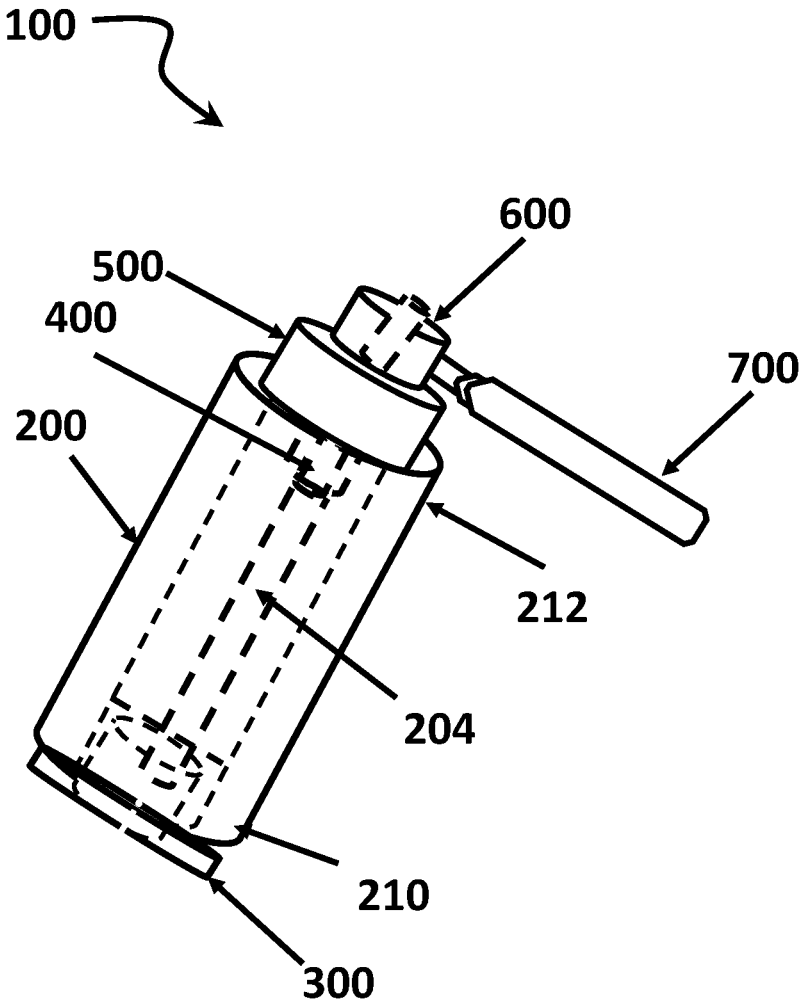
FIG. 1 is an exemplary depiction of a hair coloring wand according to various exemplary embodiments of the present invention.
Figure 2:
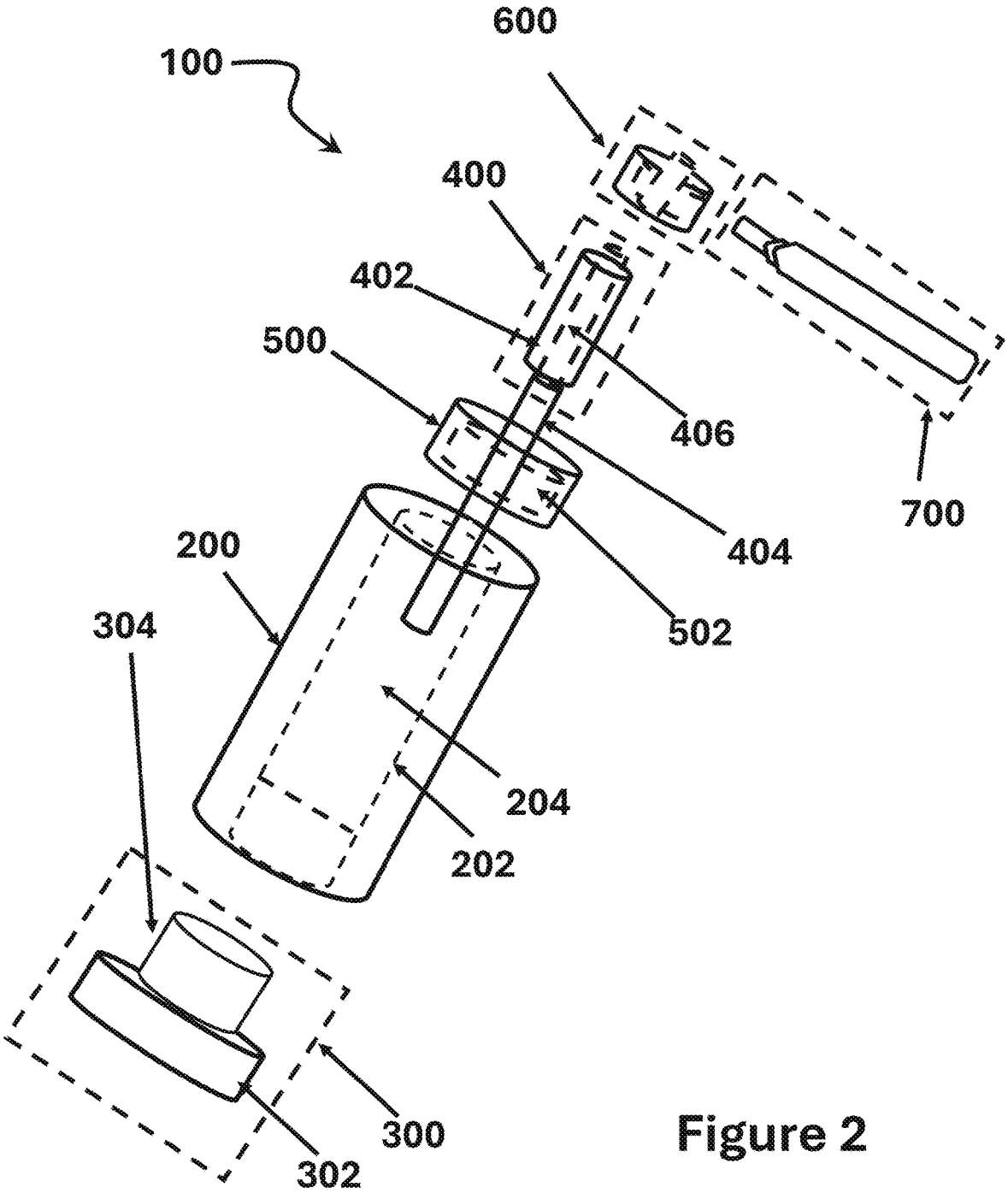
FIG. 2 is an exemplary depiction of the elements of an exemplary embodiment of a hair coloring wand according to exemplary embodiments of the present invention.

The present invention relates to a hair coloring wand for use in applying a coloring agent to the top surface of a layer of human hair, without the use of bowls and brushes found in a traditional salon. The present invention is a hand-held device that is manually activated. The hair coloring wand herein is described with respect to these figures, discloses preferred an exemplary embodiments of the invention FIG. 1 and FIG. 2 are exemplary depictions of an exploded viewpoint of a hair coloring wand 100 according to various embodiments of this invention. Hair coloring wand 100 may include a coloring agent container 200. Coloring agent container 200 may include a container bottom 300 attached to a coloring agent container second end 210. Coloring agent container 200 may include a coloring agent pump 400 affixed at a coloring agent container first end 212.

In some exemplary embodiments, hair coloring wand 100 may include a container shroud 500 interposed between coloring agent container 200 and coloring agent pump 400. In other exemplary embodiments, coloring agent pump 400 and container shroud 500 may be one contiguous element. In yet other exemplary embodiments, container shroud 500 may be configured to receive coloring agent pump 400 in mating fashion.

Hair coloring wand 100 may further include a coloring agent dispensing housing 600 connected to coloring agent pump 400 for receiving any coloring agent pumped from coloring agent container 200. In some instances, coloring agent dispensing housing 600 may be configured to allow the user to manually control the amount of coloring agent pumped from coloring agent container 200.

Further still, hair coloring wand 100 may further include a coloring agent dispensing paddle 700 connected to the coloring agent dispensing housing 600. In some exemplary embodiments, coloring agent dispensing housing and coloring agent dispensing paddle 700 may be contiguous elements. In other exemplary embodiments, dispensing paddle 700 is removably connected to dispensing housing 600.

While FIG. 2 shows hair coloring wand 100 in exploded view, FIG. 1 depicts an exemplary hair coloring wand 100 showing how one element of the invention is connected to the other. A complete understanding of the invention can be made by referring to FIGS. 1-2, inclusive.

Figure 3:
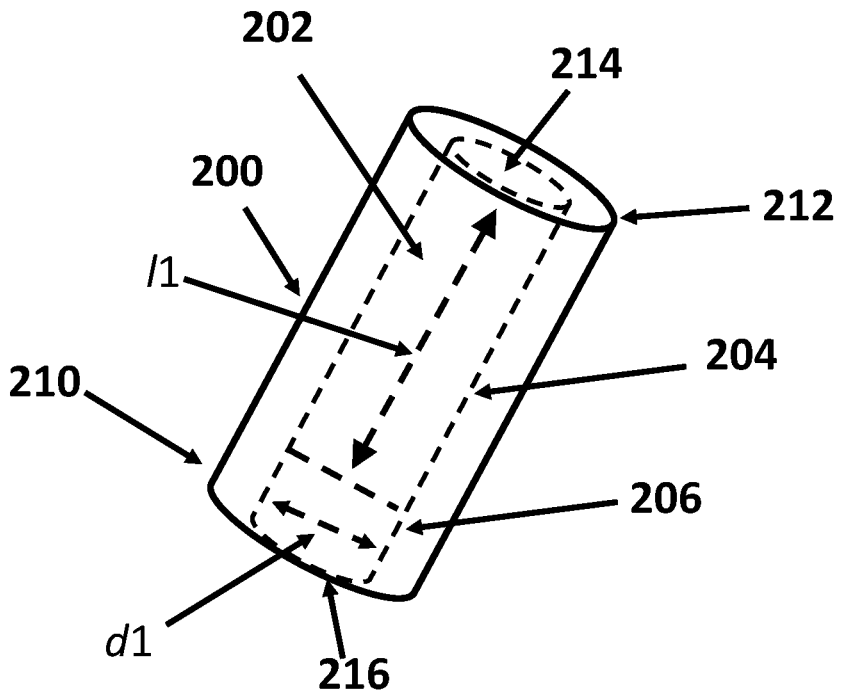
FIG. 3 is an exemplary coloring agent container according to the present invention.

FIG. 3 depicts an exemplary coloring agent container 200 according to exemplary embodiments of the present invention. In one embodiment, coloring agent container 200 may be a container having an inner cavity 202 capable of storing a liquid such as a coloring agent.

Coloring agent container 200 may be cylindrical. In another exemplary embodiment, coloring agent container 200 may include a first open end 214 at coloring agent container first end 212, and a second open end 216 at coloring agent container second end 221 be hollow. In yet another exemplary embodiment, coloring agent container 200 comprises an inner cavity 202 having a first open end 214 at coloring agent container first end 212, and a second open end 216 at coloring container second end 210.

Figure 4:
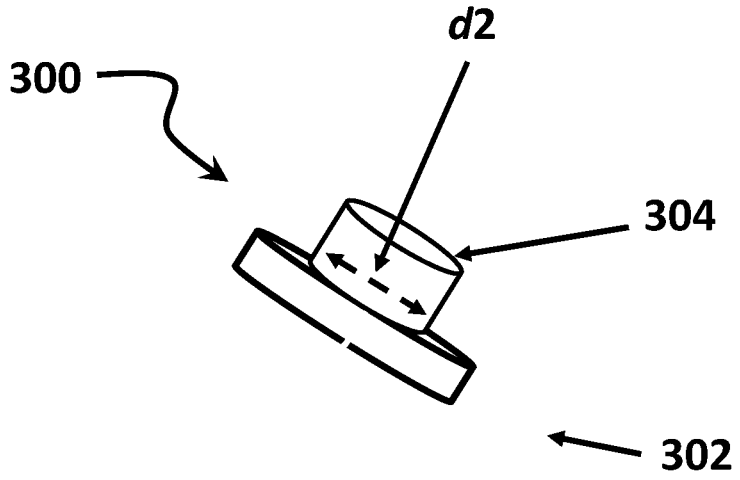
FIG. 4 is an exemplary container bottom according to various exemplary embodiments of the present invention.

Inner cavity 202 may be formed along a length, l1, of the coloring agent container 200. In one particular embodiment, the width of inner cavity 202 may, the width measured as the inner wall 204 diameter, d1. Hair coloring wand 100 may further include a container bottom 300 for use in sealing coloring agent container second opening 216. FIG. 4 is an exemplary depiction of container bottom 300 useful with this invention.

Container bottom 300 may have a container bottom upper surface 304. Container bottom upper surface 304 may have an exterior diameter, d2, that is a slightly less diameter than diameter, d1, of container inner cavity 202 defined by color container inner wall 204 diameter, d1. This allows for container bottom upper surface 304 to be placed within the color container inner cavity 216 at, for example, coloring agent container second end 210 to form a closed container end. In particular, container bottom upper surface 304 may be inserted inside inner cavity 216 when container bottom 300 seals coloring agent container 200 as described herein.

In one example, inner wall 204 may include an inner wall portion 206 that may be configured to mate with container bottom upper surface 304. Inner wall portion 206 preferably may be in proximity of the coloring agent container second end 210. Container bottom upper surface 304 may include conventional threads, joint and log, push-to-lock, or any other conventional manner in which a lid may be secured to, connected, mated to, or other while secured to a container inner wall portion 206. In which instance, container inner wall portion 206 may also have conventional threads, joint and log, push-to-lock, or any other conventional manner in which a lid may be secured to, connected, mated to container bottom upper surface 304. In one exemplary embodiment, the container bottom 300 may be secured to the coloring agent container second end 210 using any conventional method that would prevent a liquid from leaving the inner cavity 202 from color container second end 210.

Figure 5:
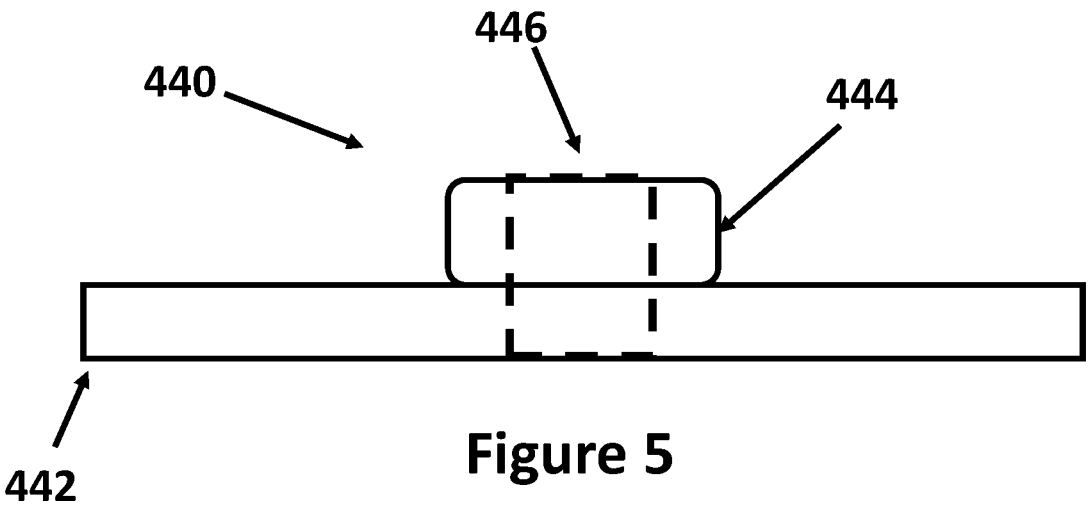
FIG. 5 is an exemplary container top according to various exemplary embodiments of the present invention.

FIG. 5 illustrates and exemplary coloring agent container top 440, which may be formed at coloring agent container first end 212. Coloring agent container top 440 may include an outer edge 442 formed to mate with coloring agent container first end 214. In one embodiment, coloring agent container 200 and coloring agent container top 440 form one contiguous element. In alternate embodiments, coloring agent container 200 and coloring container top 440 are separate elements placed in abutment. For example, coloring container top outer edge 442 may include threads, a push-to-lock mechanism, or any such joining mechanism to mate with the coloring agent container first end 212. In that regard, a first portion of coloring agent container inner cavity 202 in proximity to first end 212 may be configured to mate with color container top outer edge 442.

Figure 6:
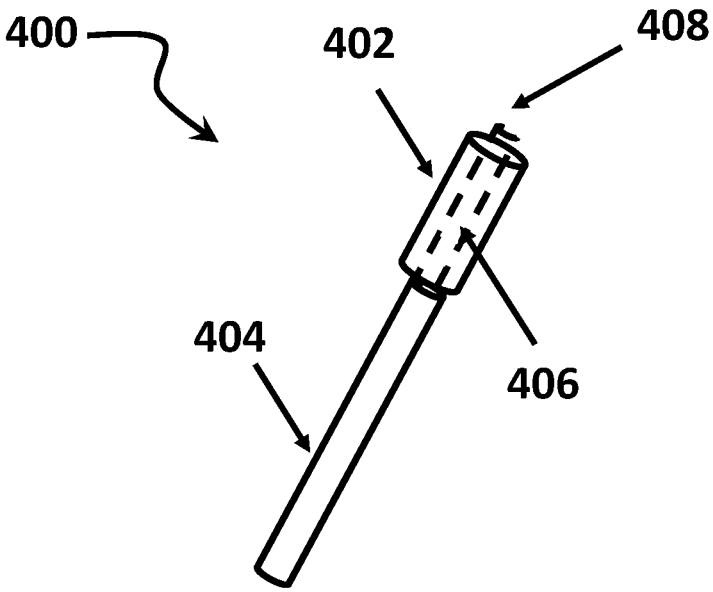
FIG. 6 is an exemplary coloring agent pump according to various exemplary embodiments of the present invention.

FIG. 6 is an exemplary depiction of a coloring agent pump 400 useful with the present invention. Although coloring agent pump 400 is described as a pump, coloring agent pump 400 may operate to pump, suck, or may otherwise displace liquid included in coloring agent container inner cavity 202 for the purpose of removing the liquid or coloring agent from container inner cavity 202.

Coloring agent pump 400 may be similar in construction to any conventional low volume manually operated pumps, such as, those use in medicine or cosmetology. A typical coloring agent pump 400 may include a manually controlled actuating mechanism 402 for controlling operation of coloring agent pump 400. A typical actuating mechanism 402 may include a spring, or the like, compressing in the axial direction defined by a suction tube (i.e., suction tube 404) included in coloring agent container inner cavity 202. Similar pumps that may be used with the present invention includes a conventional pump as is found in lotion bottles. Indeed, conventional methods for removably affixing a cosmetic pump to a bottle or other container is well known, and will not be repeated herein for brevity.

In one exemplary embodiment, coloring agent pump 400 further includes a suction tube 404 affixed to the control actuating mechanism 402. Suction tube 404 may be inserted into the color container inner cavity 202. As such, in a preferred embodiment, control actuating mechanism 402 includes a compression mechanism which causes a suction or a compression to retrieve liquid from a container. Another suitable pump that may be used with this invention is the pump disclosed in U.S. Pat. No. 8,231,031.

Coloring agent container top 440 may have a container top upper surface 444 that forms an opening 446 to provide access to coloring agent container inner cavity 202 when coloring agent container top 440 is secured to coloring agent container second end 210. In one particular embodiment, container top upper surface 444 may include means for affixing coloring agent pump 400, thereto. For example, coloring agent pump 400 may be affixed inside the opening 446 in the container top upper surface 444. In a preferred embodiment, coloring agent pump 440, suction tube 404 is placed inside color container inner cavity. In one embodiment, coloring agent pump 400 may be affixed to the container top upper surface 444 using glue, threads, push-to-connect connections or the like, as was discussed above with respect to conventional lotion pumps and bottles.

Figure 7:
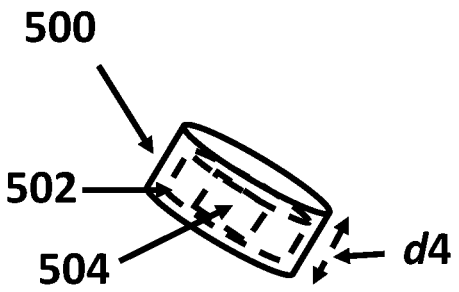
FIG. 7 is an exemplary container shroud according to various exemplary embodiments of the present invention.
Figure 8:
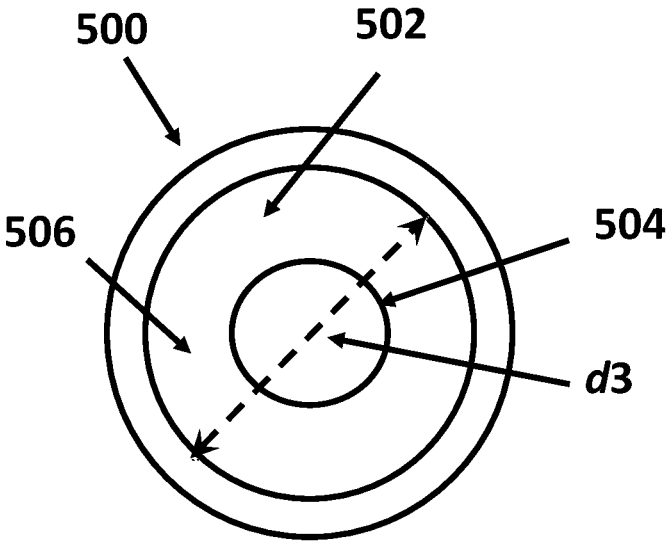
FIG. 8 is a top facing view an exemplary container shroud according to various exemplary embodiments of the present invention.

In one embodiment, the present invention may include a container shroud 500, shown in FIG. 7 and FIG. 8. Container shroud 500 may be useful for providing a surface on which coloring agent pump 400 may rest in abutment. That is, in one exemplary embodiment, container shroud may be positioned between coloring agent container top 440 and coloring agent pump 400. Container shroud 500 be an element distinct from the coloring agent container 200. In which case, container shroud 500 may be affixed to coloring agent container top 440. Container shroud 500 maybe affixed to coloring agent pump 400.

Container shroud 500 may include an upper surface 506 may be concave in shape. The container shroud upper surface having an interior diameter, d3. Container shroud upper surface may further include a predetermine depth, d4, inside the container shroud upper surface. In a preferred embodiment, container shroud 500 includes a shroud aperture 504 configured to mate with color container top upper surface 440, such that, the container shroud aperture 504 and the color container top upper surface opening 445 match to provide access to color container inner cavity 202 when the shroud 500 and container top 440.

In one exemplary embodiment, container shroud aperture 504 is configured to receive coloring agent pump 400 therein. For example, container shroud aperture 504 may be configured to receive coloring agent pump 400 therein using threads, glue, push-to-lock mechanisms and connectors as previously discussed. For example, coloring agent pump 400 may be inserted into container shroud aperture 504.

Figure 9:
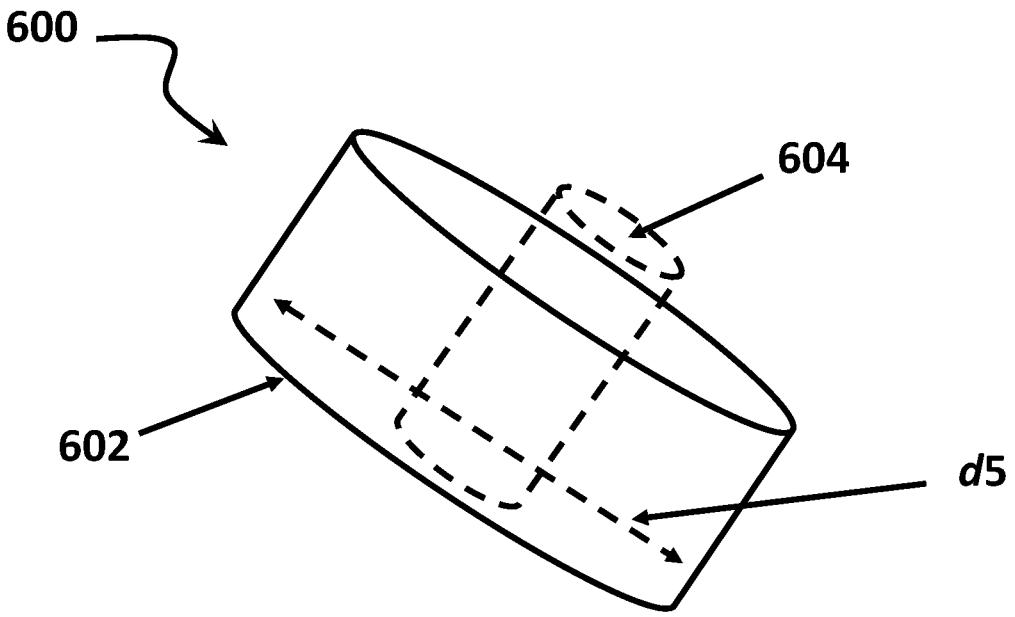
FIG. 9 is a perspective view of an exemplary coloring agent delivery housing according to various exemplary embodiments of the present invention.
Figure 10:
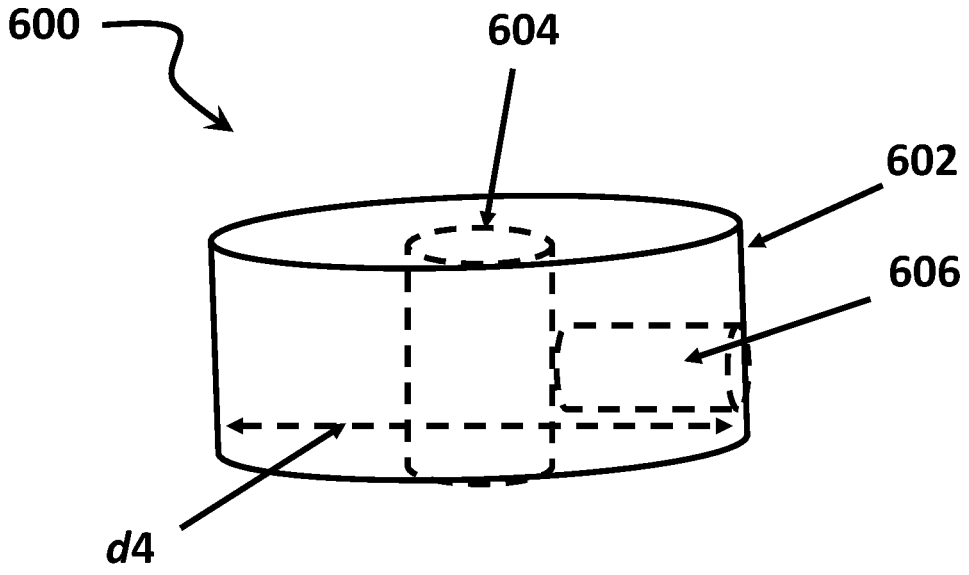
FIG. 10 is a side facing view of an exemplary coloring agent delivery housing showing an exemplary coloring agent delivery housing channel according to various exemplary embodiments of the present invention.

The present invention, as shown in FIG. 9 may further include a coloring agent delivery housing 600 in communication with coloring agent pump 400 for receiving the liquid or the coloring agent suctioned from color container inner cavity 202. The coloring agent delivery housing 600 may have an outer diameter, d5, that is slightly less than the diameter, d3, of container shroud upper surface inner 506 to allow for placement of the coloring agent delivery housing 600 within concave container shroud upper surface 502.

Coloring agent delivery housing 600 is preferable connected to coloring agent pump 400 for receiving the liquid suctioned or pumped from the coloring agent container inner cavity 202. In one exemplary embodiment, the coloring agent delivery housing 600 includes a delivery housing channel 606, which is in communication with pump suction tube 404, through a pump piston or tube 406. Delivery housing channel 606 may be placed in communication with pump suction tube 404 for receiving liquid pumped from inner cavity 202. In one exemplary embodiment, coloring agent pump 400 may include a suction tube exit 408. Coloring agent pump 400 may provide the pumped coloring agent through suction tube exit 408 during operation. Delivery housing channel 606 may be connected to suction tube exit 408 for receiving the coloring agent therefrom. The coloring agent pump 400 may be actuated manually by compressing the coloring aging delivery housing 600 axially toward the coloring agent container 200 and allowing the pump to return to its original position.

In one exemplary embodiment, coloring agent delivery housing 600 may include a coloring agent delivery housing 606 channel that is place in abutment with the coloring agent pump 406 piston for receiving the liquid suctioned from color container inner cavity 202 through suction tube 404. Alternatively, coloring agent delivery housing 600 may include a coloring agent delivery housing 606 channel that is place in abutment with suction tube exit 408 for receiving the liquid suctioned from color container inner cavity 202 through suction tube 404. The coloring agent delivery housing channel 606 may be further connected to a coloring agent delivery paddle 700.

Figure 11:
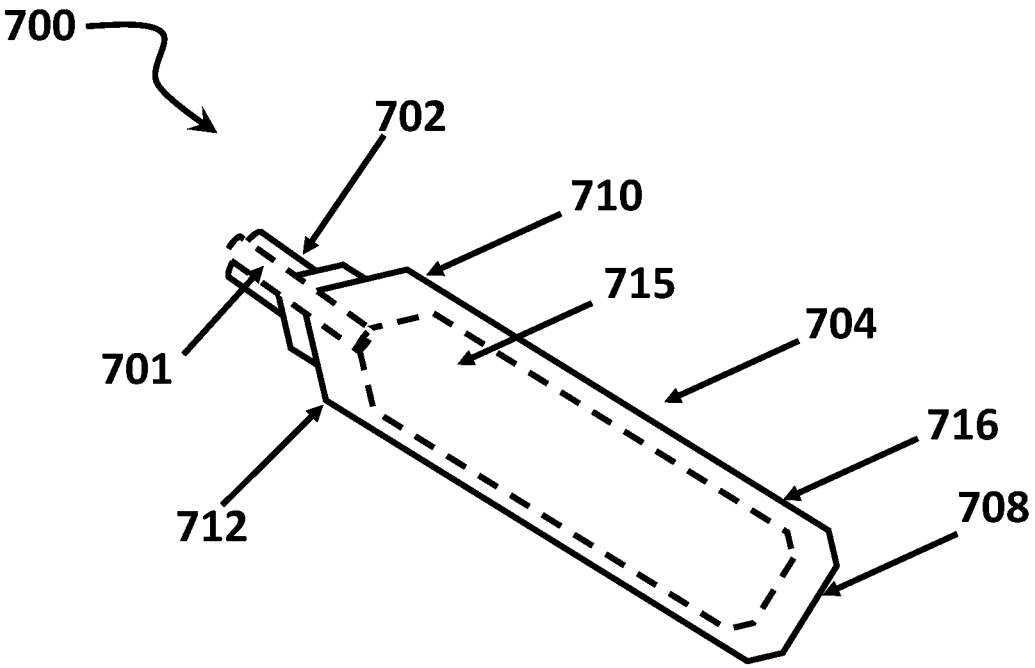
FIG. 11 is a top side perspective view of a coloring agent delivery paddle showing the delivery paddle upper surface according to various exemplary embodiments of the present invention.
Figure 12:
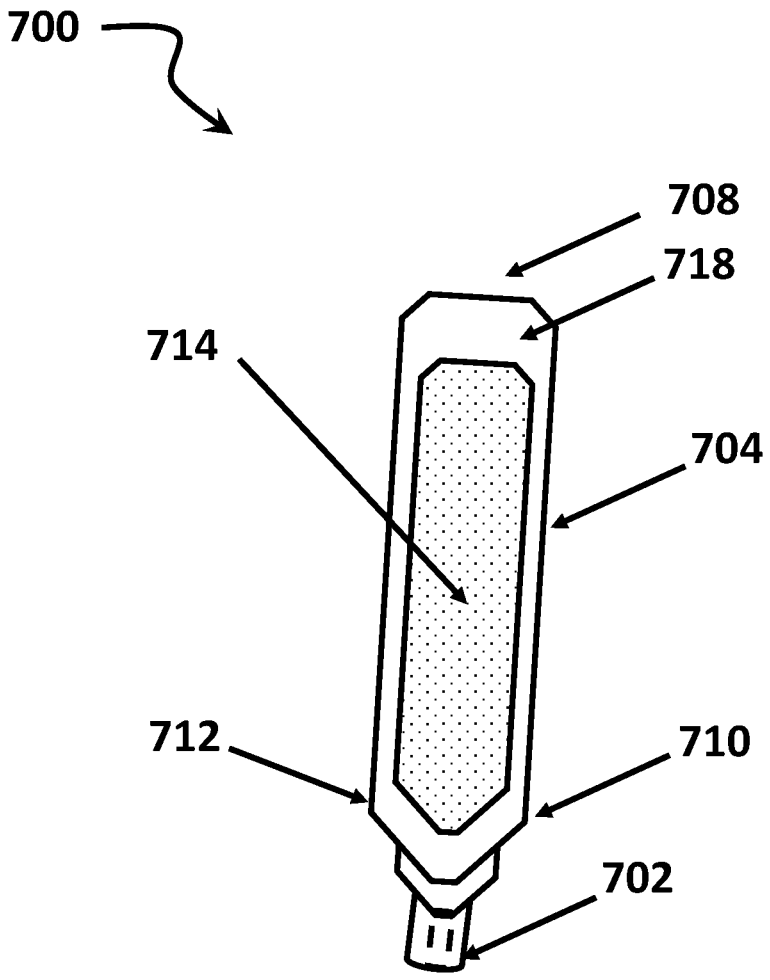
FIG. 12 is a bottom side perspective view of a coloring agent delivery paddle 700 showing the delivery paddle lower surface depicting coloring agent dispensing holes according to various exemplary embodiments of the present invention.

In one exemplary embodiment, as shown in FIGS. 11 and 12, coloring agent delivery paddle 700 is shaped like a conventional paddle, having a throat 702, a blade 704 and a blade tip 708. Blade 704 may further include a left blade shoulder 712 and a right blade shoulder 710, in similar blade and shoulder placement as is understood with conventional paddies and oars. Coloring agent delivery paddle 700 blade includes a paddle blade upper surface 716 and a paddle blade upper surface 718, wherein the paddle blade upper surface 716 and the paddle blade upper surface 718 may be defined by a plane drawn from the paddle blade left shoulder 712 to the paddle blade right shoulder 710. In one particular embodiment, the paddle blade lower surface 718 is facing toward the coloring agent container bottom 300 when included with coloring agent container 200.

Paddle blade upper surface 716 and paddle blade upper surface 718 form a cavity 715 between them. The cavity 715 is formed from the delivery paddle throat 702 to the delivery paddle tip 708. The delivery paddle cavity 715 is open at the delivery paddle throat 702 at throat opening 701 to provide access to the delivery paddle cavity 715. As such, the delivery paddle throat 702 may be placed in abutment with coloring agent delivery housing 600 channel 506 for receiving liquid delivered by the coloring agent delivery housing 606 channel. The delivery paddle throat 702 may be connected to the coloring agent delivery housing channel 506 using any of the affixing methods discussed herein. In a preferred embodiment, delivery paddle cavity 715 is closed at the delivery paddle tip 708 end to contain the liquid in the delivery paddle cavity 715.

Paddle blade lower surface 718 may include a plurality of dispensing holes 714 dispersed throughout. The paddle bade lower surface 718 dispensing holes are configured to permit any liquid or coloring agent contained in the delivery paddle cavity 715 to be expelled through the dispensing holes 714.

In some exemplary embodiments, dispensing holes 714 may appear in a predetermined hole pattern on paddle blade lower surface 718. The hole pattern may be selected according to the desired hair coloring or shading result desired. Additionally, the diameter of the dispensing holes 714 may have varying diameters on the paddle blade lower surface 718. In one particular embodiment of the dispensing hole 714, the diameter of one of the plurality of adjacent dispensing holes 714 may not be equal to the diameter of a second one of the plurality of adjacent dispensing holes 714.

The hair coloring wand 100 of the present invention may be used to apply a hair coloring agent to the hair. The structural design of the hair coloring wand paddle 700 includes dispensing holes 714 allows the user to place the coloring agent on the top layer of the hair only. More specifically, the present invention allows the user to "sweep" the coloring agent on the surface of a layer of hair.

For example, during operation, the user would separate the hair into layers that are able to be handled by a single human hand. One skilled in the cosmetic arts will understand the process of layering with the human hand for hair dressing. The operation of a conventional pump, such as coloring agent pump 400, is well known and will not be discussed herein for brevity.

Once the hair is separated into a layer for coloring, a user would pump (compressing piston 406 including a spring) manually, using for example, the human thumb. Compressed pump piston 406 may then be allowed to return to its original uncompressed position. In one exemplary embodiment, when the piston 406 is returned to its uncompressed position, coloring agent is sucked up (i.e., "drawn up") into the suction tube 404 and out through suction tube exit 408.

The coloring agent may then be delivered to delivery housing channel 606. Delivery housing channel 606 may then delivery the coloring agent to paddle throat 702 and then into paddle cavity 715. As the user compresses and decompresses pump 400, then cavity 715 will fill to capacity causing the coloring agent to be dispensed from dispensing holes 718.

Figure 13:
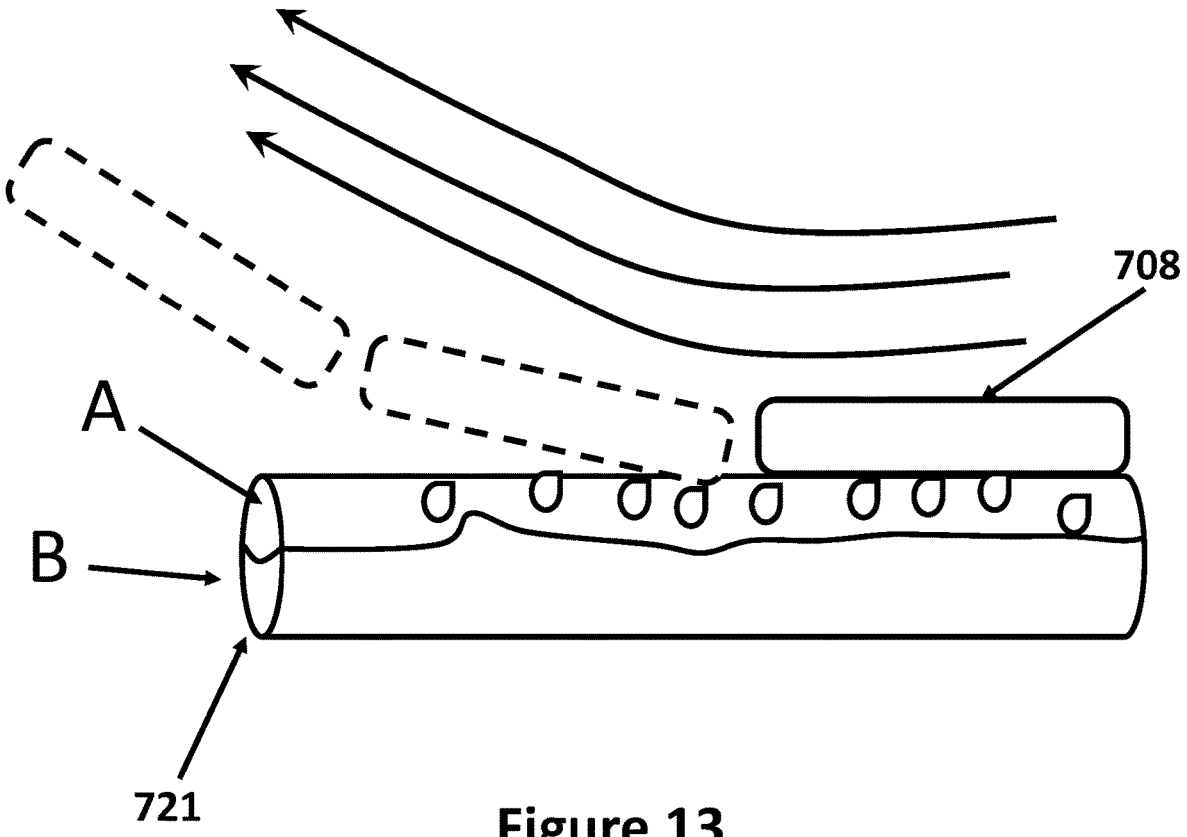
FIG. 13 is a depiction of a human hair that has been colored using an exemplary hair coloring wand according to exemplary embodiments of the present invention, showing the top surface of a layer of hair being colored with a coloring agent.

Once the coloring agent begins to be dispensed from dispensing holes 718, the use would sweep the paddle 400 across the top of the layer of hair. FIG. 13 illustrates the use the paddle 700 (paddle tip 708, shown) sweeping across a layer of human hair 218. As shown, paddle 700 is swept across the top of the layer of hair 721, such that only the top surface of the hair is contacted by the coloring agent. As shown, only the top surface of the hair, A, is contacted by the coloring agent, while the lower surface of the hair is untouched. In this way, the user may only add coloring agent to the top surface of a layer of hair 721 without coloring the layer lower surface.

It should be noted that various embodiments of the invention are described with respect to the individual elements of the invention. However, it is contemplated that the present invention may have elements that are detachable, such as, the paddle 700. Further, while the present invention discusses a color agent, such modifications are within the spirit and scope of the invention.

Additionally, where the present invention discusses elements as being connected, in communication, or in abutment with, it should be understood that the elements may be physically connected using conventional threads, push-to-lock, press to fit or the like.

I claim:

1. A hair coloring wand, comprising:

a coloring agent container having a coloring agent container first end, a coloring agent container second end, and a coloring agent container inner cavity for receiving a coloring agent;

a container bottom removably affixed to the coloring agent container second end;

a coloring agent pump removably affixed to the coloring agent container first end, the coloring agent pump including a suction tube for including in the coloring agent container inner cavity, the suction tube for being placed in contact with the coloring agent, the suction tube having a suction tube exit;

a coloring agent dispensing housing affixed to the suction tube exit; and a bristleless hair coloring wand affixed to the dispensing housing, the bristleless hair coloring wand including a plurality of coloring agent dispensing holes.

2. The hair coloring wand according to claim 1, wherein the plurality of color agent dispensing holes are organized in a predetermined pattern.

3. The hair coloring wand according to claim 1, wherein the diameter of at least one of the plurality of color agent dispensing holes is larger than the diameter of an adjacent one of the at least plurality of color agent dispensing holes.

4. The hair coloring wand according to claim 1, wherein the bristleless hair coloring wand is removably affixed to the coloring agent dispensing housing.

5. A hair coloring wand, comprising:

a coloring agent container having a coloring agent container first end and a coloring agent container second end, and a coloring agent container inner cavity for receiving a coloring agent;

a container bottom removably affixed to the coloring agent container second end;

a container top affixed to the coloring agent container first end, wherein the container top includes an opening that allows access to the coloring agent container inner cavity;

a coloring agent pump having a pump first end including a suction tube, and a pump second end including a suction tube exit, the coloring agent pump removably affixed to the container first end, wherein the suction tube is inserted in the coloring agent container inner cavity, the suction tube for being placed in contact with the coloring agent;

a coloring agent dispensing housing including a dispending housing channel, wherein the dispensing housing channel is affixed to the suction tube exit; and a bristleless coloring agent paddle including a paddle throat and a paddle cavity, wherein the paddle throat is affixed to the dispensing housing channel, the paddle throat is in communication with the paddle cavity, wherein bristleless the hair coloring wand including a plurality of coloring agent dispensing holes providing access to the paddle cavity.

6. The hair coloring wand according to claim 5, wherein the plurality of color agent dispensing holes are organized in a predetermined pattern.

7. The hair coloring wand according to claim 5, wherein the diameter of at least one of the plurality of color agent dispensing holes is larger than the diameter of an adjacent one of the at least plurality of color agent dispensing holes.

8. The hair coloring wand according to claim 5, wherein the bristleless hair coloring wand is removably affixed to the coloring agent dispensing housing channel.

9. A hair coloring wand, comprising:

a coloring agent container having a coloring agent container first end and a coloring agent container second end, and a coloring agent container inner cavity for receiving a coloring agent;

a container bottom removably affixed to the coloring agent container second end;

a container top affixed to the coloring agent container first end, wherein the container top includes an opening that allows access to the coloring agent container inner cavity;

a container shroud affixed to the container top, the container shroud having a container shroud opening that allows access to the container inner cavity through the container top opening;

a coloring agent pump having a pump first end including a suction tube, and a pump second end including a suction tube exit, the coloring agent pump removably affixed to the container shroud opening, wherein the suction tube is inserted in the container shroud opening, and wherein the suction tube is inserted in the container top opening, and wherein the suction tube is inserted in coloring agent container inner cavity, the suction tube for being placed in contact with the coloring agent;

a coloring agent dispensing housing including a dispending housing channel, wherein the dispensing housing channel is affixed to the suction tube exit; and a bristleless coloring agent paddle including a paddle throat and a paddle cavity, wherein the paddle throat is affixed to the dispensing housing channel, the paddle throat is in communication with the paddle cavity, wherein the bristleless hair coloring wand including a plurality of coloring agent dispensing holes providing access to the paddle cavity.

10. The hair coloring wand according to claim 9, wherein the plurality of color agent dispensing holes are organized in a predetermined pattern.

11. The hair coloring wand according to claim 9, wherein the diameter of at least one of the plurality of color agent dispensing holes is larger than the diameter of an adjacent one of the at least plurality of color agent dispensing holes.

12. The hair coloring wand according to claim 9, wherein the bristleless hair coloring wand is removably affixed to the coloring agent dispensing housing channel.

* * * * *